US007222390B2

(12) United States Patent
Cipolla et al.

(10) Patent No.: US 7,222,390 B2
(45) Date of Patent: May 29, 2007

(54) CLUTCHLESS SELF-PROPELLED VACUUM CLEANER AND NOZZLE HEIGHT ADJUSTMENT MECHANISM THEREFOR

(75) Inventors: Mark E. Cipolla, Chardon, OH (US); Steven J. Paliobeis, Painesville, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 420 days.

(21) Appl. No.: 10/339,191

(22) Filed: Jan. 9, 2003

(65) Prior Publication Data

US 2004/0134019 A1 Jul. 15, 2004

(51) Int. Cl.
*A47L 9/00* (2006.01)

(52) U.S. Cl. ..... 15/340.2; 15/319; 15/340.1

(58) Field of Classification Search ..... 15/340.1, 15/340.2, 319, 389, 340.3
See application file for complete search history.

(56) References Cited

U.S. PATENT DOCUMENTS

| | | | | |
|---|---|---|---|---|
| 1,459,946 | A | 6/1923 | Camarata et al. | |
| 1,465,285 | A | 8/1923 | Peterson | |
| 2,619,209 | A | 11/1952 | Horn | |
| 2,814,063 | A | 11/1957 | Ripple | |
| 2,950,772 | A | 8/1960 | Dostal et al. | |
| 3,218,876 | A | 11/1965 | Berger | |
| 3,220,043 | A | 11/1965 | Lampe | |
| 3,451,495 | A | 6/1969 | Bayless et al. | |
| 3,581,591 | A | 6/1971 | Ziegler et al. | |
| 3,618,687 | A | 11/1971 | Ripple et al. | |
| 3,823,791 | A | 7/1974 | Sheler | |
| 3,854,164 | A | 12/1974 | Schmitz | 15/377 |
| 3,896,892 | A * | 7/1975 | Kohls et al. | 180/19.2 |
| 3,938,216 | A | 2/1976 | Schmitz et al. | |
| 4,249,281 | A | 2/1981 | Meyer et al. | 15/410 |
| 4,347,643 | A | 9/1982 | Bair, III | |
| 4,434,865 | A | 3/1984 | Tschudy et al. | |
| 4,615,071 | A | 10/1986 | Frohbieter | |
| 4,766,640 | A | 8/1988 | Martin et al. | 15/390 |
| 5,042,109 | A | 8/1991 | Stephens | 15/354 |
| 5,056,175 | A * | 10/1991 | Stein et al. | 15/339 |
| 5,115,537 | A | 5/1992 | Meyer et al. | 15/340.2 |
| RE34,286 | E * | 6/1993 | Toyoshima et al. | 15/319 |
| 5,269,042 | A | 12/1993 | Stephens et al. | 15/356 |
| 5,285,550 | A | 2/1994 | Meyer et al. | 15/328 |
| 5,335,740 | A | 8/1994 | Meyer et al. | |
| 5,504,971 | A | 4/1996 | McCormick | 15/340.2 |
| 5,974,622 | A | 11/1999 | Louis et al. | |

(Continued)

FOREIGN PATENT DOCUMENTS

| | | | |
|---|---|---|---|
| JP | 1-185233 | * | 7/1989 |

*Primary Examiner*—Theresa T. Snider
(74) *Attorney, Agent, or Firm*—Fay Sharpe LLP

(57) ABSTRACT

A clutchless, direct drive, self-propelled vacuum cleaner includes a nozzle base having a suction inlet and a housing pivotally mounted on the nozzle base. A suction source is mounted to one of the nozzle base and the housing. A filter chamber is located in one of the nozzle base and the housing. A drive motor is mounted to one of the nozzle base and the housing, the drive motor having an output shaft. A transmission is directly coupled to the output shaft of the motor. A driven wheel is directly coupled to the transmission. Also disclosed is a height adjustment mechanism for the vacuum cleaner, the height adjustment mechanism employing the drive assembly of the vacuum cleaner.

13 Claims, 11 Drawing Sheets

U.S. PATENT DOCUMENTS

| | | | | |
|---|---|---|---|---|
| 6,061,869 | A | 5/2000 | Ettes et al. | |
| 6,108,862 | A | 8/2000 | Frederick et al. | |
| 6,449,792 | B1 | 9/2002 | Myers | |
| 6,658,692 | B2 * | 12/2003 | Lenkiewicz et al. | 15/320 |
| 2001/0039691 | A1 | 11/2001 | Bobrosky et al. | |
| 2002/0170137 | A1 | 11/2002 | Coates et al. | |
| 2002/0174507 | A1 * | 11/2002 | Kasper et al. | 15/340.2 |
| 2004/0134019 | A1 | 7/2004 | Cipolla et al. | |
| 2004/0135537 | A1 | 7/2004 | Conner et al. | |
| 2005/0071056 | A1 * | 3/2005 | Tondra et al. | 701/23 |

* cited by examiner

CLUTCHLESS SELF-PROPELLED VACUUM CLEANER AND NOZZLE HEIGHT ADJUSTMENT MECHANISM THEREFOR

BACKGROUND OF THE INVENTION

The present invention relates to vacuum cleaners. More specifically, the invention relates to self-propelled vacuum cleaners.

Known self-propelled vacuum cleaners include an electric motor disposed in a nozzle base of the cleaner for driving a set of driven wheels. The drive motor, via a clutch, exerts a driving force on the driven wheels in the direction of movement desired by the operator. Some operators value self-propelled vacuum cleaners because they are easier to move from place to place while vacuuming a room.

In the prior art self-propelled vacuum cleaners, a clutch mechanism is provided to allow the motor, which normally rotates only in a single direction, to drive the vacuum cleaner in both a forward and a reversed direction. It is apparent that clutches add to the complexity of the vacuum cleaner power drive system. Accordingly, it would be desirable to have a clutchless direct drive type vacuum cleaner.

As is well known, vacuum cleaners also include height adjustment mechanisms to enable the vacuum cleaner to be employed on carpeting of various heights or on bare floors. Conventionally, the nozzle base had to include both drive wheels for the power drive mechanism and separate rollers or wheels which were coupled to the nozzle height adjustment mechanism of the vacuum cleaner. Accordingly, it would be desirable to provide a drive mechanism which can also serve as part of a height adjustment mechanism for the vacuum cleaner in order to reduce the number of parts in the nozzle base, thereby reducing both the complexity and the cost of manufacture of the nozzle base.

SUMMARY OF THE INVENTION

According to the present invention, a new and improved self-propelled vacuum cleaner is provided. More particularly, in accordance with one aspect of the invention, a clutchless direct drive, self-propelled vacuum cleaner comprises a nozzle base having a suction inlet and a housing pivotally mounted on the nozzle base. A suction source is mounted to one of the nozzle base and the housing. A filter chamber is located in one of the nozzle base and the housing. A drive motor is mounted to one of the nozzle base and the housing, the drive motor having an output shaft. A transmission is directly coupled to the output shaft of the motor and a driven wheel is directly coupled to the transmission.

In accordance with another aspect of the invention, a direct drive self-propelled vacuum cleaner is provided. More particularly, in accordance with this aspect of the invention, a nozzle base having a suction inlet is provided and a housing is pivotally mounted on the nozzle base. A suction source is mounted to one of the nozzle base and the housing. A filter chamber is located in one of the nozzle base and the housing. A drive motor is mounted to one of the nozzle base and the housing with the drive motor having an output shaft. A control is located in one of the housing and the nozzle base for directing a rotational direction and speed of the drive motor. A transmission is directly coupled to the output shaft of the drive motor. A driven wheel is directly coupled to the transmission.

In accordance with still another aspect of the invention, a height adjustment mechanism is provided for a self-propelled vacuum cleaner. The height adjustment mechanism comprises a nozzle base having a suction inlet, an upright housing pivotally mounted to the nozzle base and a suction source mounted to one of the nozzle base and the upright housing. A filter chamber is located in one of the nozzle base and the upright housing. A drive motor is mounted on a motor housing pivotally connected to the nozzle base. A driven wheel is connected to the drive motor. A height adjustment control is mounted to the nozzle base and a cam is connected to the height adjustment control. A height adjustment lifter is pivotally mounted to the nozzle base and cooperates with the cam. The height adjustment lifter contacts the motor housing to rotate same and thus adjust a height of the suction inlet in relation to an associated subjacent support surface.

In accordance with yet another aspect of the present invention, a height adjustment mechanism is provided for a self-propelled vacuum cleaner. More particularly, in accordance with this aspect of the invention, a nozzle base having a suction inlet is provided. At least one wheel is rotatably mounted to the nozzle base for supporting the nozzle base on an associated subjacent support surface. A housing is connected to the nozzle base and a suction source is mounted to one of the nozzle base and the housing. A filter chamber is located in one of the nozzle base and the housing. A drive motor is mounted to the nozzle base, the drive motor having an output shaft. A driven wheel is coupled to the drive motor output shaft. A height adjustment control is mounted to the nozzle base and a cam is connected to the height adjustment control. A height adjustment lifter is pivotally mounted to the nozzle base and cooperates with the cam, wherein the height adjustment lifter contacts the motor housing to rotate same and thus adjust a height of the suction inlet in relation to the associated surface.

The advantages and benefits of the present invention will become apparent to those of ordinary skill in the art upon a reading and understanding of the following detailed description of the preferred embodiment.

BRIEF DESCRIPTION OF THE DRAWINGS

The drawings are only for purposes of illustrating a preferred embodiment of the present invention and are not to be construed as limiting same. The invention may take form in various components and arrangements of components and in various steps and arrangements of steps, a preferred embodiment of which will be illustrated in the accompanying drawings and wherein.

DETAILED DESCRIPTION OF THE PREFERRED EMBODIMENT

Figure 1:
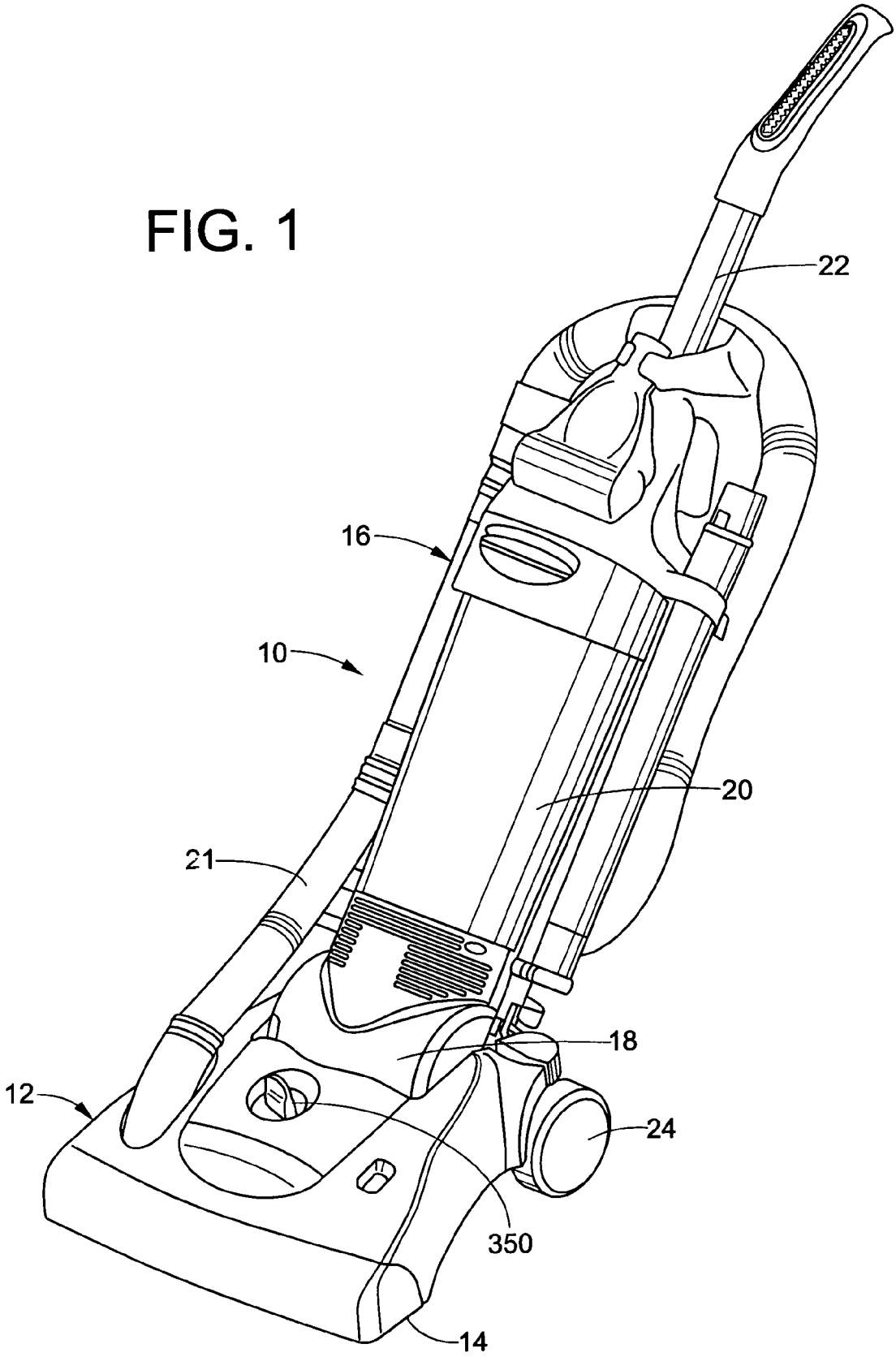
FIG. 1 is a perspective view illustrating a self-propelled upright vacuum cleaner in accordance with the present invention.
Figure 9:
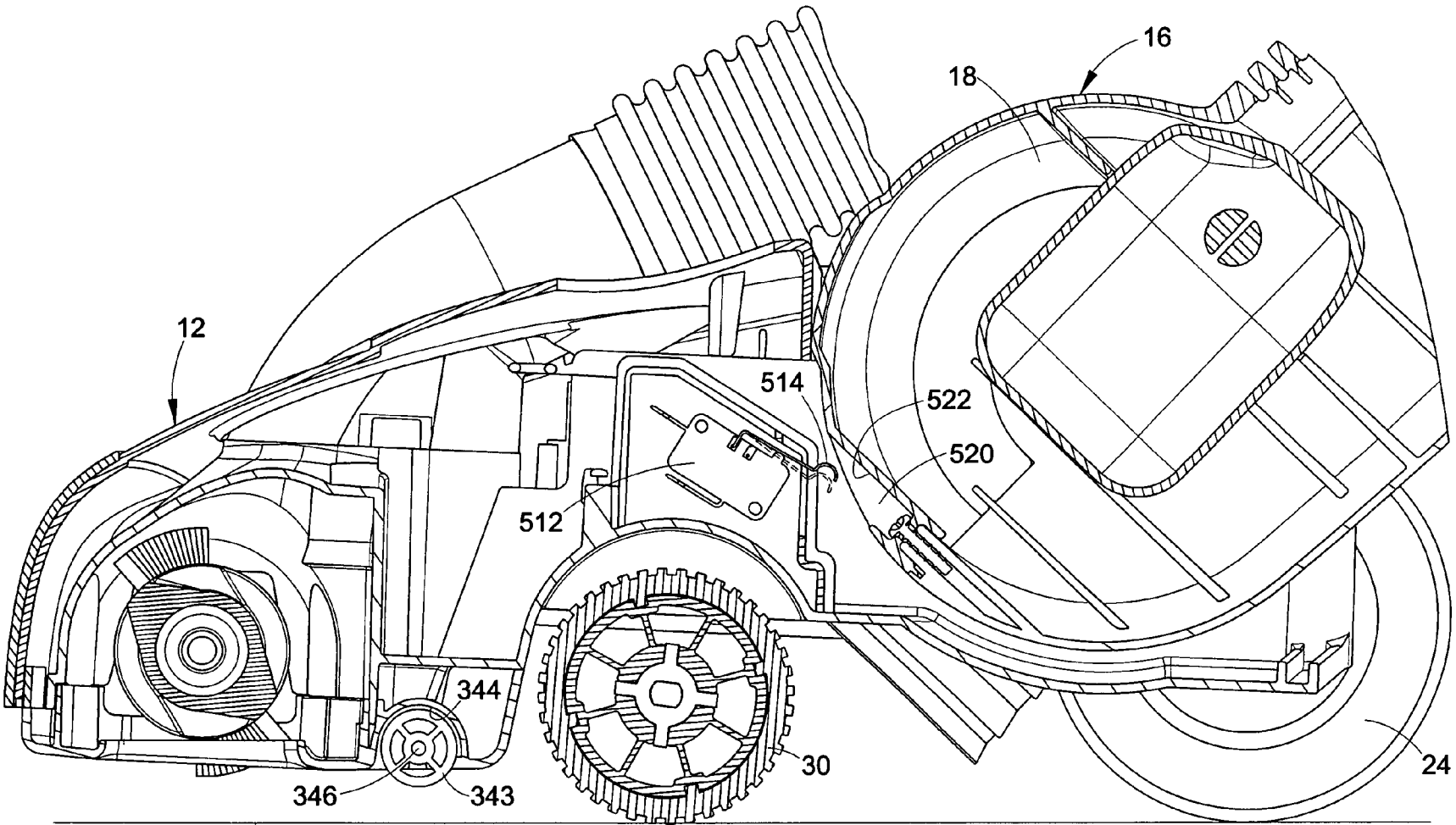
FIG. 9 is an enlarged side elevational view of the nozzle base of FIG. 8 along another section.

Referring now to the figures wherein the showings are for purposes of illustrating a preferred embodiment of the present invention and not for purposes of limiting same, FIG. 1 illustrates a self-propelled upright vacuum cleaner 10. The upright vacuum cleaner includes a nozzle base 12 having a suction inlet 14. An upright housing 16 is pivotally mounted on the base 12. A suction source 18, which conventionally includes a motor fan assembly is disposed in one of the base 12 and the upright housing 16. As best shown in FIG. 9, the motor is mounted in a lower portion of the upright housing 16.

A filter chamber 20 is mounted to one of the base and the upright housing. The suction source communicates the suction inlet 14, through conduits, such as the hose illustrated at 21, with the filter chamber 20, as is well known in the art. The filter chamber 20 and its communication with the suction inlet is discussed in greater detail in application Ser. No. 10/224,483 which was filed on Aug. 20, 2002 and is entitled "Vacuum Cleaner Having Hose Detachable at Nozzle". That application is incorporated herein by reference in its entirety. In order to allow a user to maneuver the vacuum cleaner, a handle assembly 22 is mounted to the upright housing 20. Also, a pair of rear wheels 24 (see FIG. 5) support the base 12 above the surface meant to be cleaned in order to facilitate movement of the vacuum cleaner across the surface.

Figure 5:
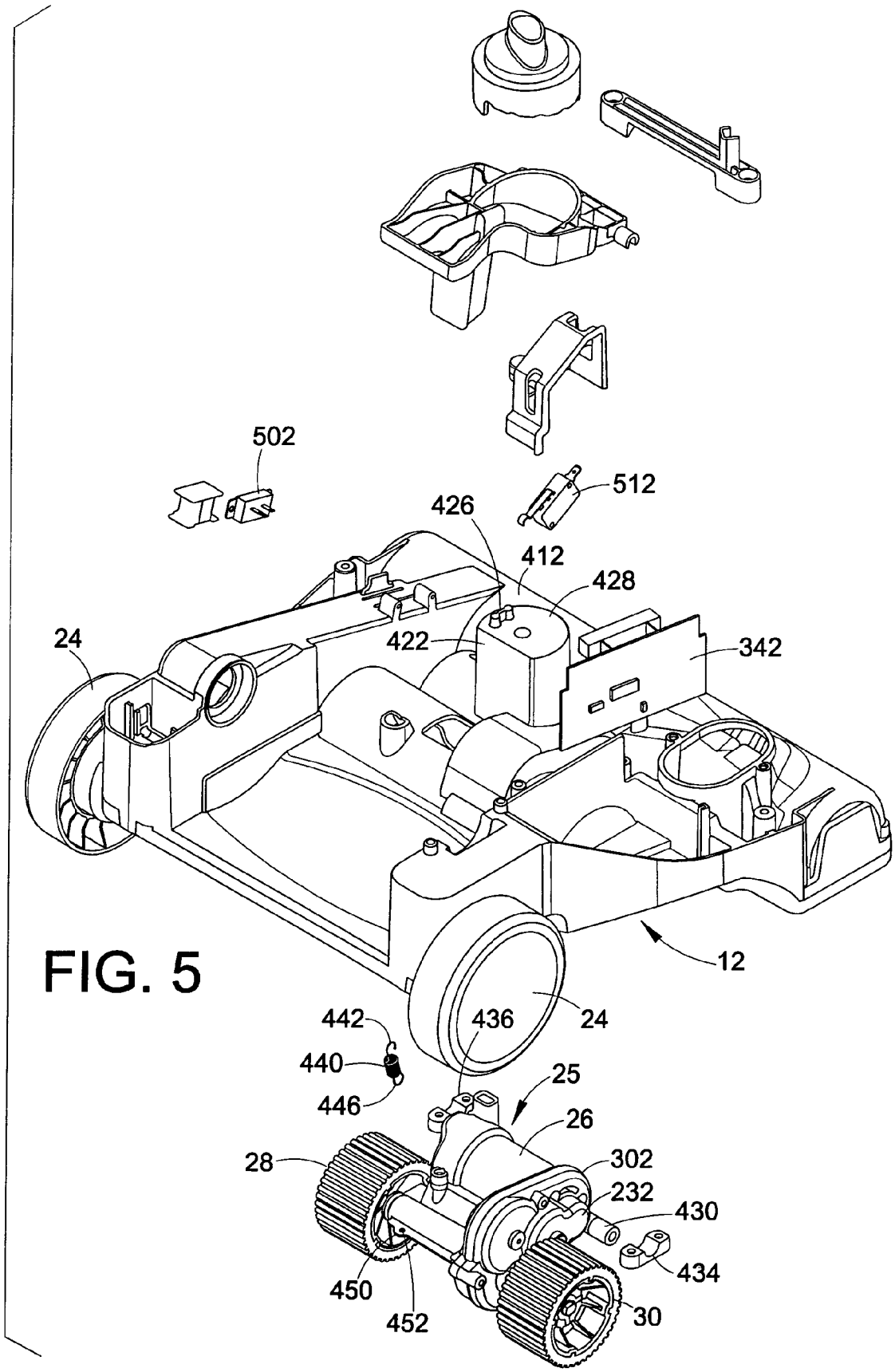
FIG. 5 is an enlarged exploded perspective view of a base assembly of the vacuum cleaner of FIG. 1.

With reference now to FIG. 5, the vacuum cleaner 10 includes a drive assembly 25 including a drive motor 26 operatively connected to driven wheels 28 and 30 such that the drive motor drives the wheels to propel the base. With reference again to FIG. 1, an operator of the vacuum cleaner can control the speed and direction of rotation of the wheels 28 and 30 by manipulating the handle assembly 22. The drive motor 26 is in communication via circuitry (not shown) with a sensor assembly, which will be described in more detail below, located in the handle assembly 22. As the operator manipulates the handle assembly 22, the drive motor 26 reacts to propel the base accordingly.

Figure 2:
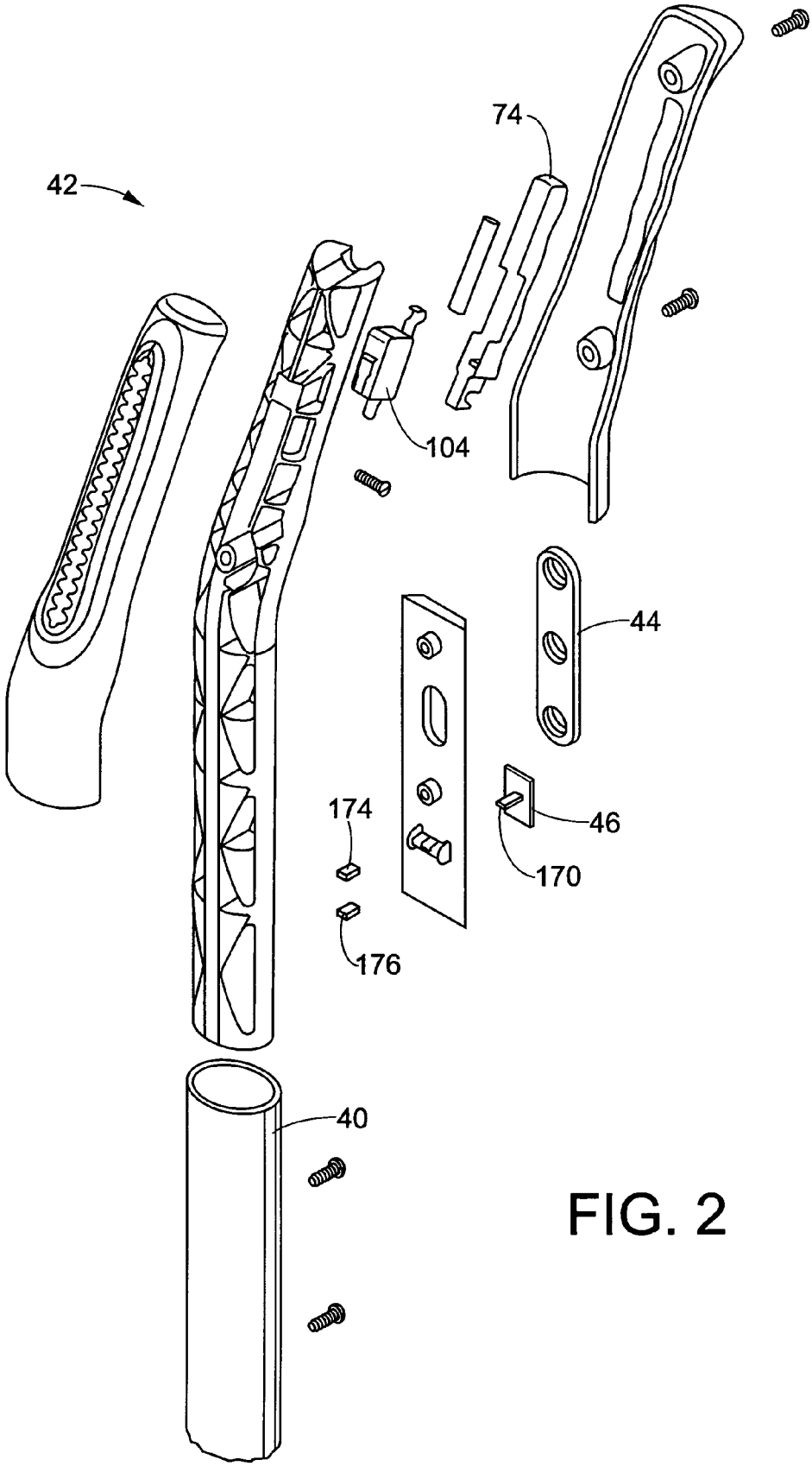
FIG. 2 is an enlarged exploded perspective view of an upper portion of the vacuum cleaner including a handle assembly.

With reference now to FIG. 2, the handle assembly 22 includes an upper handle 40, a handle grip assembly 42, a neutral return spring 44 and a sensor assembly 46 that communicates through known electrical circuitry (not shown) to control the speed and direction of rotation of the motor 26. Additional description of the handle assembly, the neutral return spring and the sensor assembly is found in a patent application entitled "Self-propelled Vacuum Cleaner With Neutral Return Spring", Ser. No. 10/339,749, filed on Jan. 9, 2003. The subject matter of that application is incorporated by reference hereinto in its entirety.

Figure 3:
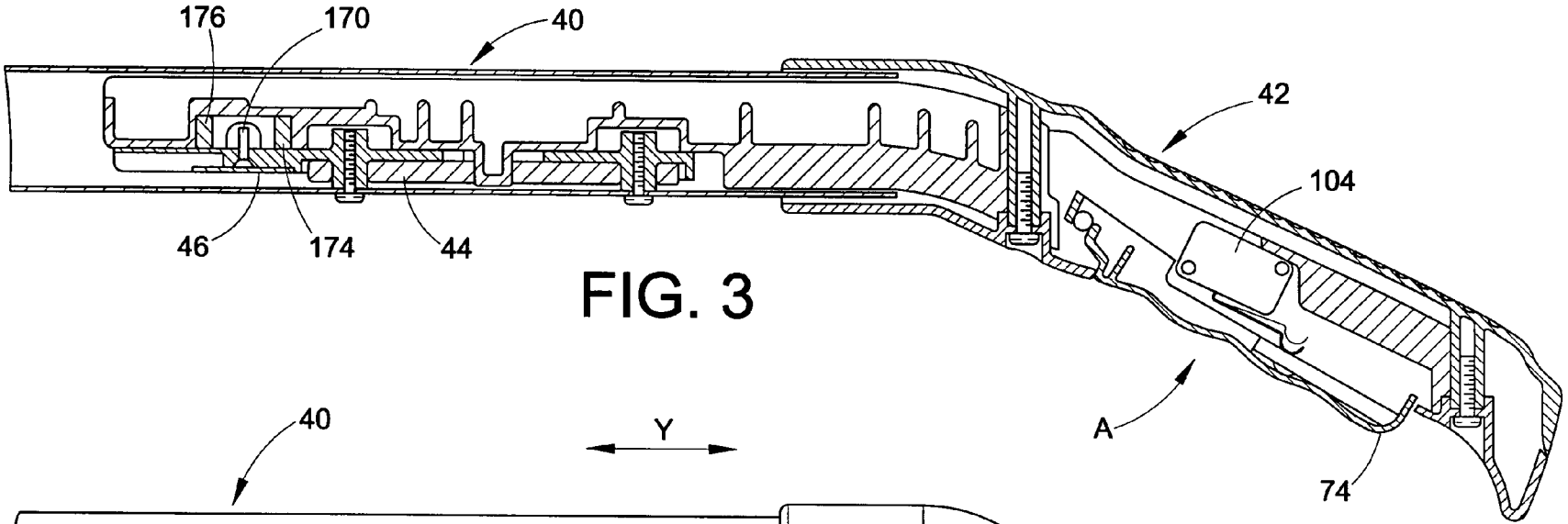
FIG. 3 is an assembled side elevational view, in cross-section, of a handle assembly of FIG. 2.
Figure 4:
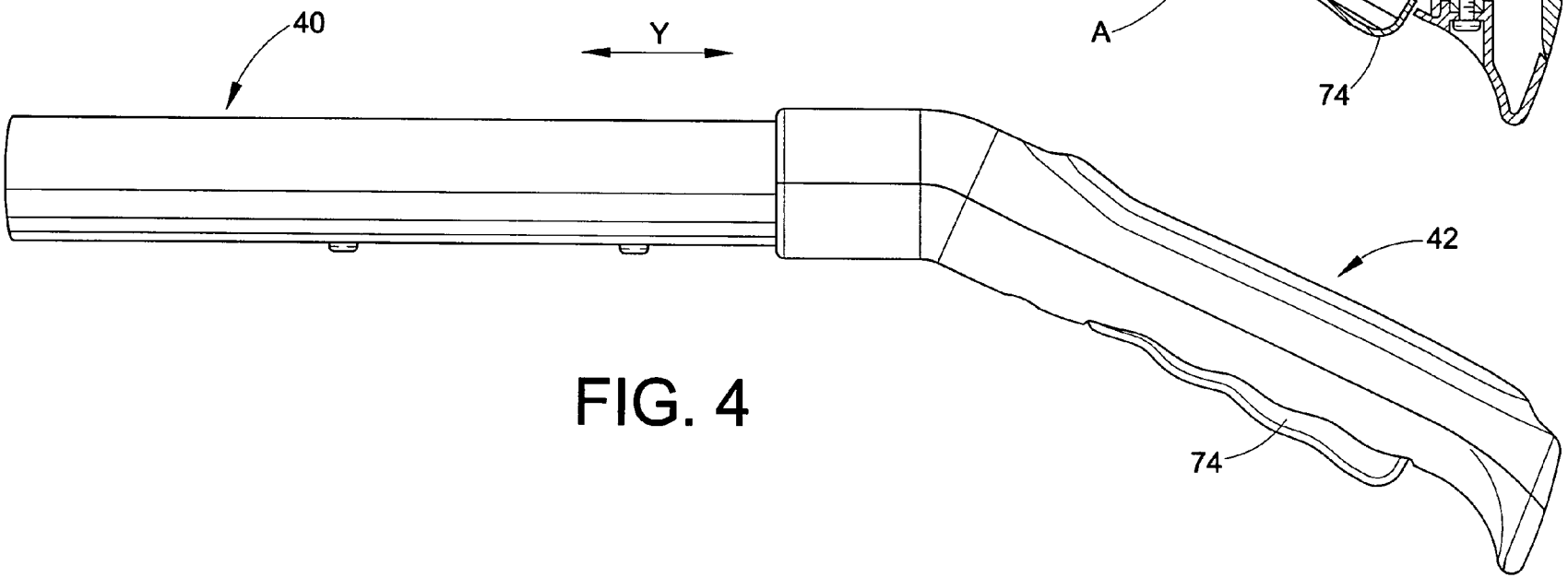
FIG. 4 is a side elevational view of the handle assembly of FIG. 3.

Briefly, a switch trigger 74 on the handle grip assembly 42 is employed to selectively actuate the drive motor 26. The switch trigger actuates a switch 104 which is electrically connected via circuitry (not shown) to a power cord (not shown) that can connect to an external power source. The power source supplies power to the suction source 18 and to the drive motor 26. To activate the switch 104, and thus to power the drive motor 26, the operator depresses the trigger 74 as depicted by arrow A in FIG. 3. Letting go of the trigger 74 will deactivate the drive motor 26. A separate switch (not visible in FIG. 1) is used to selectively power the suction source 18. As described in the copending application referenced above, the sensor assembly 46 can include a Hall effect probe 170 and a pair of spaced magnets 174 and 176. The neutral return spring has inherent damping characteristics to reduce the possibility of directing the motor to quickly change from a forward rotation to a backward rotation, and back again, instead of simply stopping its rotation when a pulling or pushing force, indicated by arrow Y in FIG. 4, on the hand grip assembly 42 is stopped by the operator.

As mentioned, the operator manipulates the handle assembly 22 to control the direction and speed of rotation of the drive motor 26. To this end, and with reference again to FIG. 5, the drive motor 26 can be a brushless DC reversible motor. Accordingly, a rectifier (not shown) is positioned somewhere in the electronic circuitry to convert AC power of an external power source to DC power for the motor. Of course, it should be recognized that an AC motor could be provided as well, thus obviating the need for a rectifier. The motor 26 drives a transmission 232 which in turn drives the wheels 28 and 30. The motor 26 is illustrated to be a direct drive motor, thus, eliminating the need for a clutch in the transmission to reverse the direction of rotation of the transmission and the driven wheels 28, 30.

Figure 6:
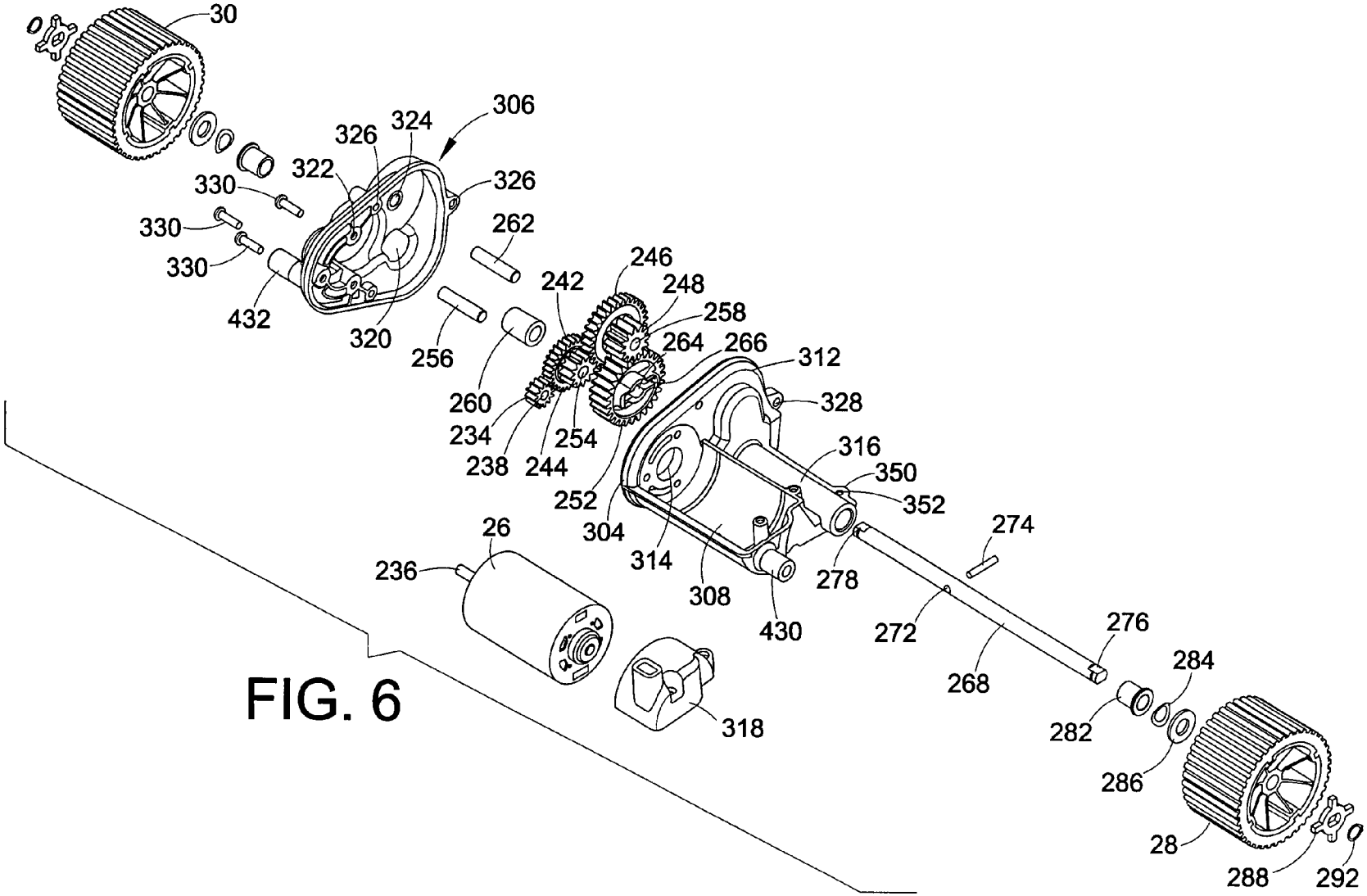
FIG. 6 is an enlarged exploded perspective view of a drive motor and transmission assembly of the vacuum cleaner of FIG. 1.

With reference now to FIG. 6, the transmission 232 includes a pinion gear 234 driven by an output shaft 236 of the motor 26. The output shaft 236 is received in an opening 238 in the pinion gear 234. The pinion gear drives a first gear 242 which includes a toothed extension 244. The extension 244 intermeshes with and drives an intermediate gear 246, that also includes an extension 248. Intermeshing with the extension 248 is a sprocket 252 driven thereby. The first gear 242 and the extension 244 include an opening 254 to receive a first gear shaft 256. The intermediate gear 246 and the extension 248 include an opening 258 to receive a second gear shaft 262. A gear spacer 260 is positioned between the first gear 242 and its housing.

The sprocket 252 includes an opening 264 having a keyed notch 266. Received in the opening 264 is an axle 268. The axle 268 includes a bore 272 to receive a pin 274. The pin 274 is received in the keyed notch 266 to lock the axle 268 to the sprocket 252. Accordingly, as the sprocket 252 rotates, it turns the axle 268. Mounted on the axle 268 are the driven wheels 28 and 30. Although a specific type of transmission has been described herein, it should be apparent to one of ordinary skill in the art that the invention encompasses many different types of transmissions.

Included on the axle 268 is a first squared end 276 that is received in an opening (not shown) in the first wheel 28 and a second squared end 278 that is received in an axle opening in the second wheel 30. A bearing 282, a curved washer 284 and a flat washer 286 are received on the axle 268. A wheel lock 288 and a retainer ring 292 are received on the squared end 276 to fasten the wheel 28 to the axle. A similar mounting arrangement is provided for the wheel 30. Although a specific type of connection between the wheels 28 and 30 and the axle 268 has been disclosed, it should be apparent that the invention encompasses any type of connection between axles and wheels that is generally known in the art.

Enclosing the transmission 232 is a transmission housing 302 (FIG. 5). The transmission housing 302 includes a first half 304 and a second half 306 of a clam shell type housing. The first half 304 includes a well 308 to receive the motor 26. The well abuts a wall 312 of the first clam shell half on one end. Protruding through an opening 314 in the wall 312 is the output shaft 236 of the motor 26. The first half 304 of the housing also includes an axle housing 316 which comprises a hollow cylindrical portion that receives the axle 268. A motor cover 318 mounts over the well 308 to secure the motor 26 in place when it is positioned in the well.

The second clam shell housing half 306 also includes an axle housing 320 to receive the axle 268. Included in the second half 306 is a first shaft opening 322 to receive the gear shaft 256 of the first gear 242 and an intermediate shaft opening 324 to receive the gear shaft 262 of the intermediate gear 246. Further, the second half also includes openings 326 that align with openings 328 on the first half 304 to receive conventional fasteners 330 for attaching the first housing half to the second housing half.

Figure 8:
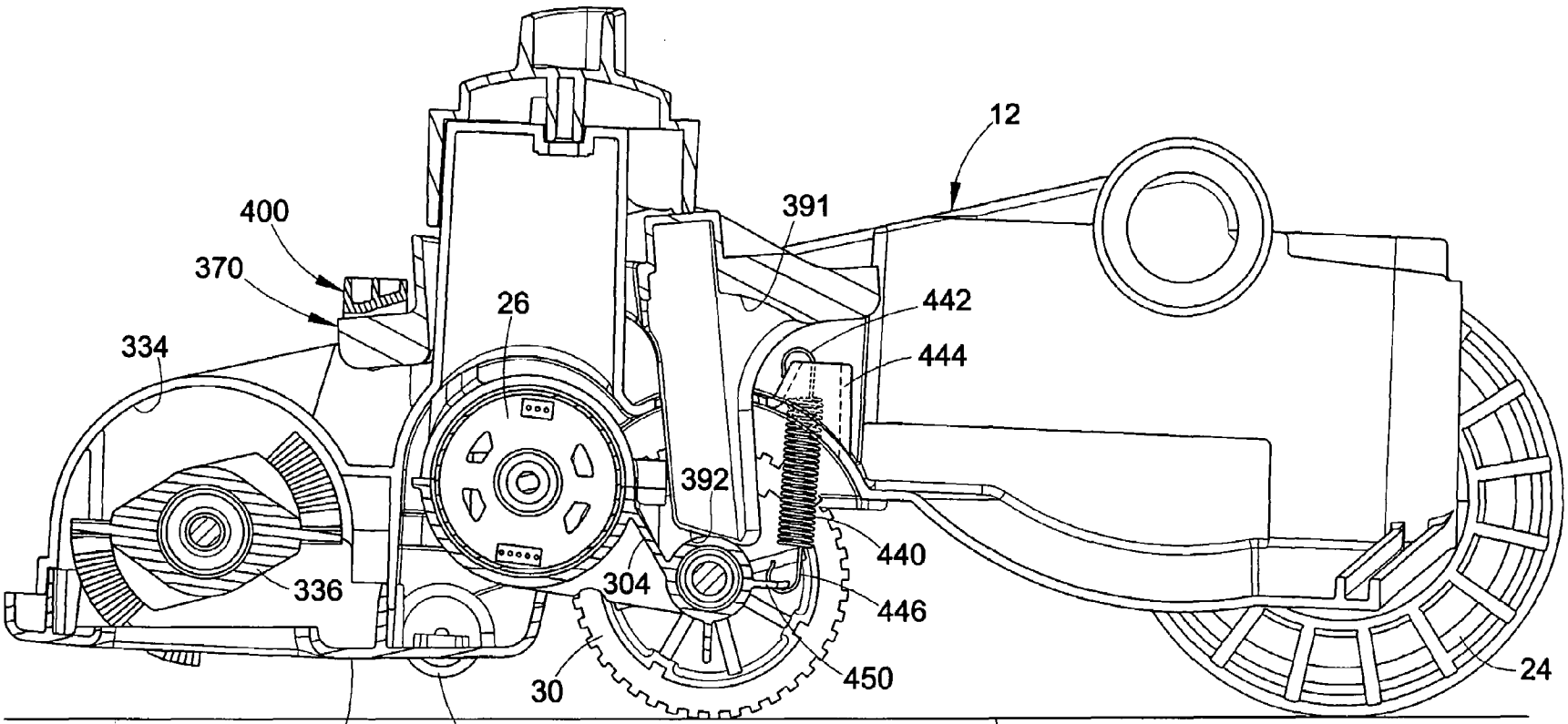
FIG. 8 is an enlarged side elevational view of the nozzle base of FIG. 1 illustrating the drive wheels of the power drive mechanism in a down position and the nozzle spaced from the floor surface.

With reference now briefly to FIG. 8, the base 12 includes a cavity 334 to house a brushroll 336. As shown in FIG. 5, a circuit board 342 is mounted to the base 12 and is electronically connected to the sensor assembly 46 described above. The sensor assembly 46, which could also be termed a detector assembly, delivers a signal to the circuit board 342 which translates the signal to control the direction of rotation and speed of the motor 26. The circuit board 342 can include various circuits to treat the electrical signal sent to the motor 26 and other controls for the motor. Such circuits and controls are disclosed in copending applications entitled "Control Circuitry for Enabling Drive System For Vacuum Cleaner", Ser. No. 10/339,097, filed on Jan. 9, 2003 and "Electronically Commutated Drive System For A Vacuum Cleaner", Ser. No. 10/339,122, filed on Jan. 9, 2003. The subject matter of these two applications is incorporated hereinto by reference in their entireties.

With reference now to FIG. 9, also provided on a nozzle base 12 is at least one roller 343 which is mounted in a roller well 344 defined on a bottom face 345 of the housing 12. A roller axle 346 pivotally mounts the roller. It is apparent from FIG. 9 that the roller is located behind the brushroll 336 but in front of the drive wheels 28 and 30. Two such rollers can, if desired, be located on the nozzle base bottom face 344. The rollers are meant to support the nozzle base adjacent its nozzle opening 14 so as to prevent the nozzle opening from approaching a subjacent surface 347 too closely.

Figure 10:
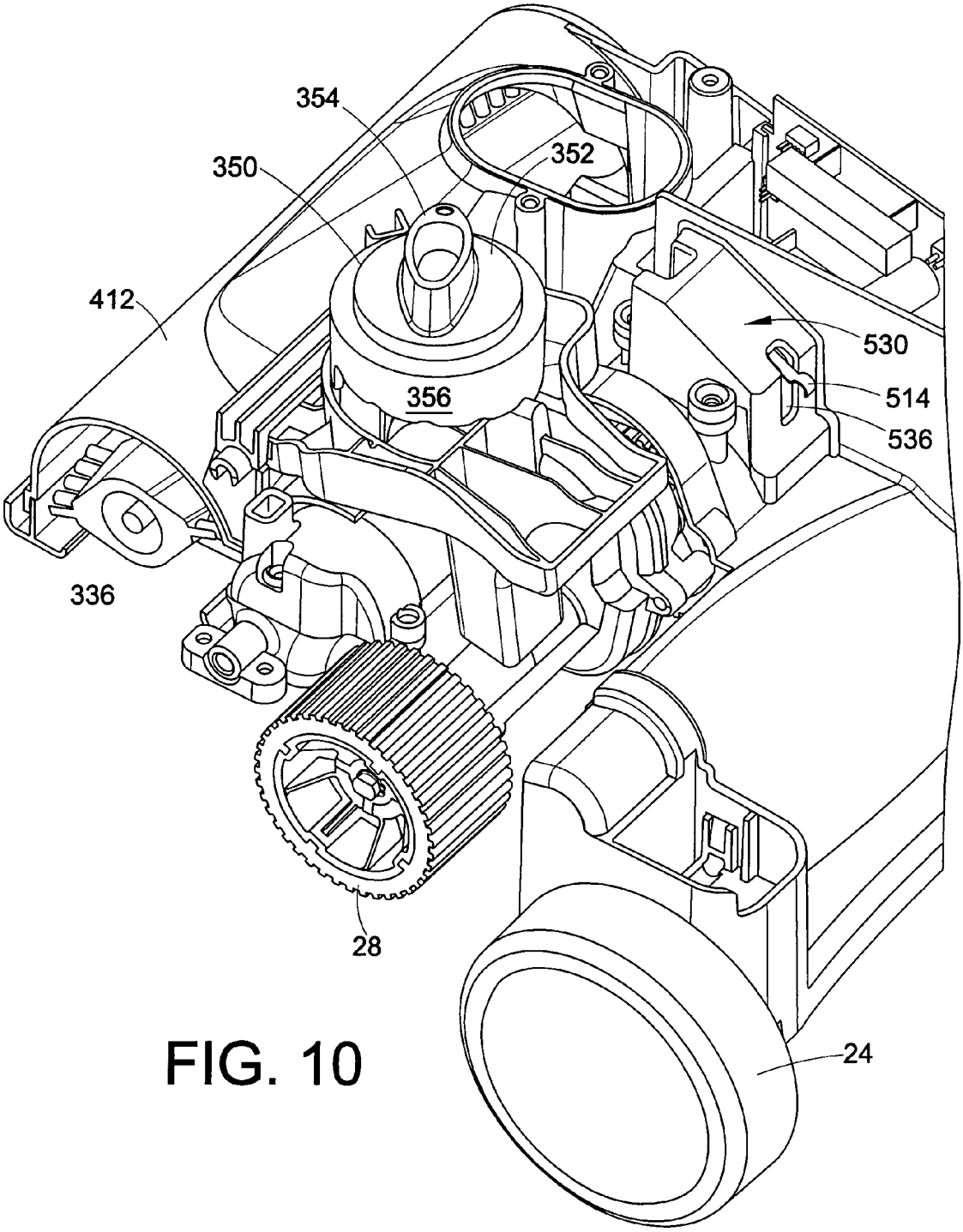
FIG. 10 is a reduced perspective view of the nozzle base of FIG. 9.
Figure 12:
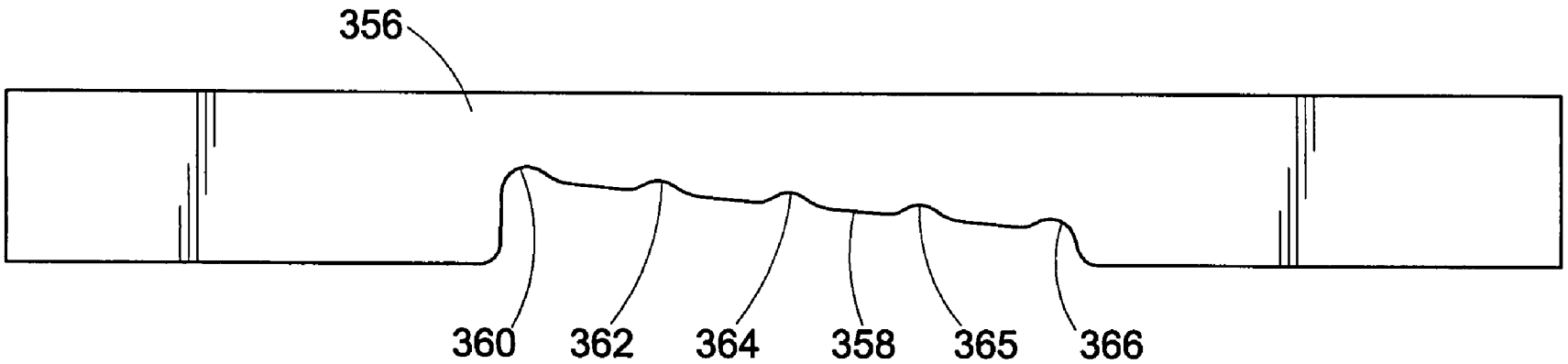

With reference now to FIG. 10, a height adjustment control 350 includes a top wall 352 extending from which is a knob 354. Also provided is a side wall 356. With reference now also to FIG. 12, defined in the side wall is a cam surface 358. The cam surface includes first through fifth sections 360-366, which are of different heights.

Figure 7:
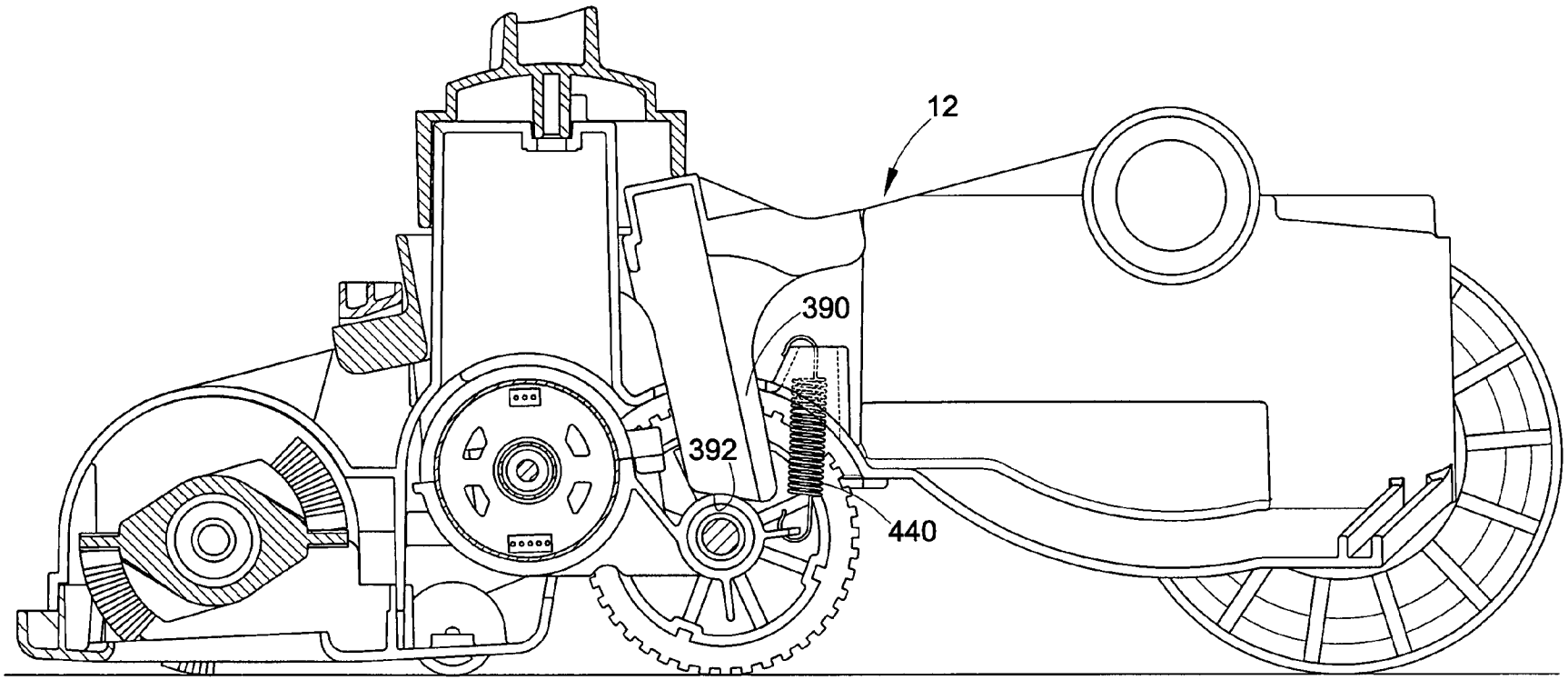
FIG. 7 is an enlarged side elevational view of the nozzle base of FIG. 1, in section, illustrating the drive wheels of a power drive assembly of the vacuum cleaner in an up position and a nozzle adjacent a floor surface.
Figure 11:
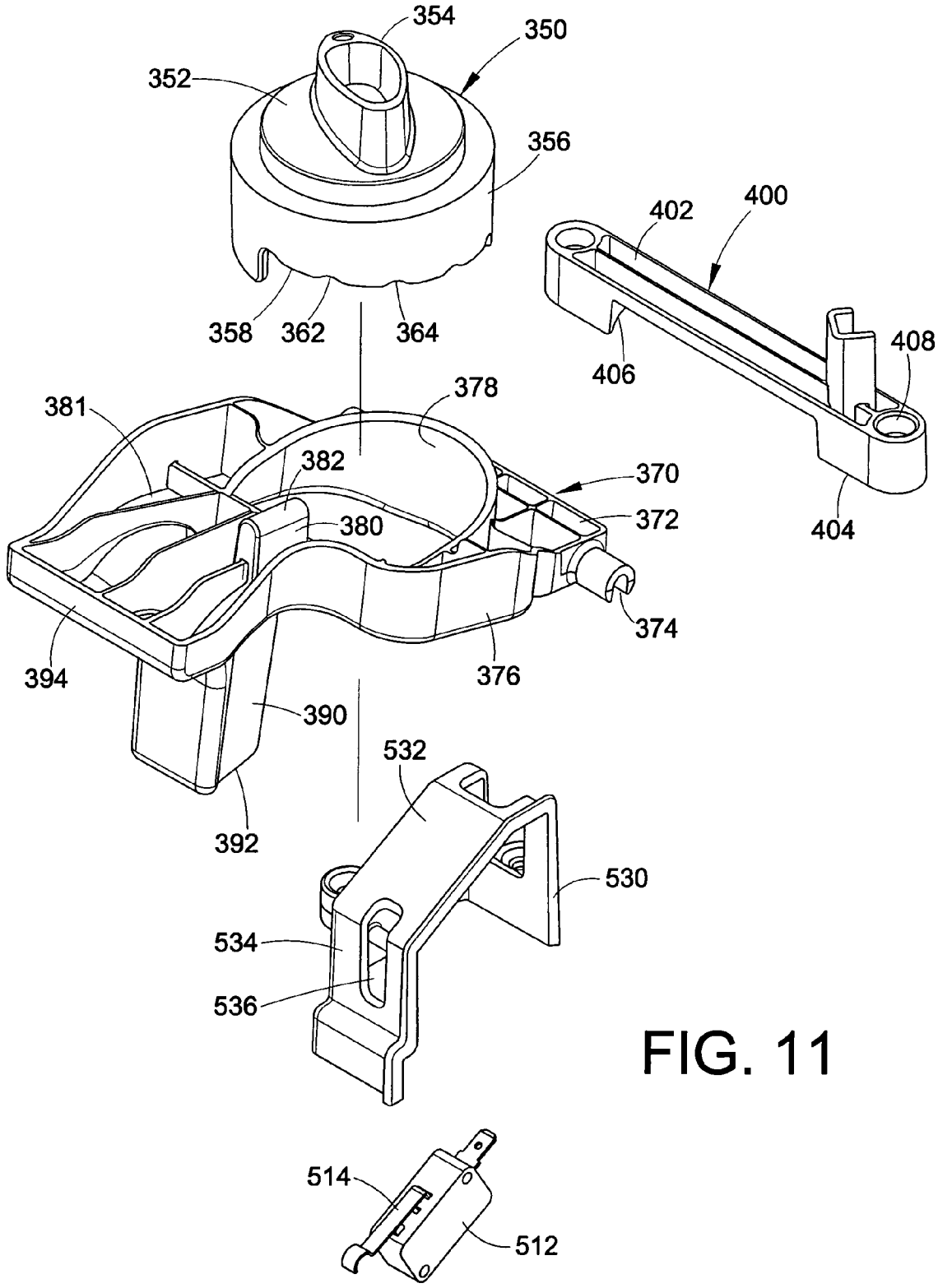
FIG. 11 is an enlarged exploded perspective view of various height adjustment components and controls of the vacuum cleaner of FIG. 10; and, FIG. 12 is a developed view of a side wall of a nozzle height adjusting knob of the vacuum cleaner of FIG. 11 illustrating a cam surface thereof.

With reference now to FIG. 11, cooperating with the height adjustment control 350 is a height adjustment lifter 370 which includes a first end 372. Defined in a first end, on opposed sides thereof, are stubs 374. A central portion 376 of the lifter has a reversed D-shaped opening 378. A first projection 380 extends from a first face 381 of the lifter 370. A contact surface 382 is provided on a distal end of the projection 380. As also shown in FIG. 7, a second projection 390 extends from a second surface 391 of the lifter. The second projection includes a contact surface 392. Positioned opposite the first end 372 is a second end 394 of the lifter.

Connecting the lifter to the nozzle base 12 is a lifter clamp 400. The clamp has an upper surface 402 and a lower surface 404. Defined in the lower surface are channel sections 406. The channel sections are meant to accommodate the lifter first end stubs 374 so as to allow a pivoting motion of the lifter first end in the channel sections. Transverse apertures 408 extend through opposed ends of the clamp for accommodating suitable fasteners (not illustrated) in order to secure the clamp in place on a pair of bosses (not visible) extending from an upper surface 412 (FIG. 10) of the nozzle base 12.

With reference again to FIG. 5, a stub 422 extends from the upper surface 412. The stub is suitably shaped and sized so as to fit through the opening 378 in the height adjustment lifter 370. A suitable fastener (not illustrated) secures the height adjustment control 350 to the stub 422 thereby trapping the height adjustment lifter 370 in place. This is best illustrated in FIGS. 7 and 8. A stop 426 is defined on an upper surface 428 of the stub 422 to limit rotation of the control 350.

The drive assembly, including the drive motor 26 and the transmission housing 302 to which the motor is mounted, together with the wheels 28 and 30, is pivotally mounted on the nozzle base 12. To this end, the transmission housing includes stubs 430 and 432, as best shown in FIG. 6. The stubs are mounted in respective supports 434 and 436 (FIG. 5) that are secured via fasteners (not shown) to the nozzle base 12. Thus, the drive assembly can pivot in relation to the nozzle base 12.

In order to bias the power drive assembly (including the motor 26 and the wheels 28 and 30) towards the nozzle base, a spring 440 is provided. As best shown in FIG. 8, the spring has a first end 442 which extends over a hollow protrusion 444 of the nozzle base 12. A second end 446 of the spring is connected to the first half 304 of the transmission housing. For this purpose, an ear 450 defined on the first half 304 is provided with an aperture 452 to accommodate the spring second end 446, as best shown in FIG. 5.

With reference again to FIG. 5, a speed selector switch 502 can be mounted to the nozzle base 12. The selector switch can control the rotational speed of the motor 26. Also mounted to the nozzle base is an enable switch 512. With reference now also to FIG. 9, the enable switch 512 has an arm 514 which extends into a recess 520 defined in the upper housing 16. To this end, when the upper housing is rotated towards a substantially upright position so that it is substantially perpendicular to the subjacent surface 347, the arm 514 will contact a wall 522 of the recess thereby deactivating the drive motor 26. As is evident from FIG. 11, a housing 530 encloses the enable switch 512 except that, defined in a rearwardly angled and a rear surface 534 upper surface 532 of the housing 530 is a slot 536. As shown in FIG. 10, the arm 514 protrudes through the slot 536.

As the height adjustment control 350 is rotated, various ones of the cam surface sections 360-366 come into contact with the contact surface 382 of the first projection 380 of the height adjustment lifter 370. Since the control 350 is rotatably mounted on the stub 422 of the nozzle base 12, and the cam surface sections 360-366 are disposed at different heights along the side wall 356, the height adjustment lifter 370 is constrained to pivot up and down in relation to the nozzle base 12. Such pivoting will cause the second projection contact surface 392 to push on the axle housing 316 of the transmission 232. The drive assembly 25 is thus rotated downwardly against the bias of spring 440, as is evident from a comparison of FIGS. 7 and 8. When the height adjustment control is again rotated to a lower height setting, both gravity and spring 440 will urge the drive assembly 25 to retract into the nozzle base 12, thus lowering the suction opening 14 towards the floor surface 347. Thus, the drive motor 26 serves two purposes, both as a means for propelling the nozzle base and as part of the height adjustment mechanism for the nozzle base.

While the motor 26 is illustrated as driving two wheels 28 and 30, it should be appreciated that the motor could drive only a single wheel or more than two wheels if so desired. Also, while the power drive motor is illustrated as being mounted to the nozzle base, it could, instead, be mounted to a suitably configured upright housing if so desired. In a design where the upright housing carries the rear wheels of the vacuum cleaner, the drive motor could be coupled to the rear wheels or to one or more separate wheels. In such a design, if coupled to the rear wheels, no extra drive wheels would be required. However, the drive mechanism would not then form part of the height adjustment system of the vacuum cleaner. While the preferred embodiment has been described with reference to such terms as "upper", "lower", "vertical", and the like, these terms are used for better understanding of the invention and with respect to the orientation of the vacuum cleaner and the surface to be cleaned. However, these terms are not meant to limit the scope of the invention.

The invention has been described with reference to a preferred embodiment. Obviously, modifications and alterations will occur to others upon a reading and understanding of the preceding detailed description. It is intended that the invention be construed as including all such modifications and alterations insofar as they come within the scope of the appended claims and the equivalents thereof.

Having thus described the preferred embodiments, the invention is now claimed to be:

1. A clutchless, direct drive, self-propelled vacuum cleaner comprising:

a nozzle base having a suction inlet at least one support wheel located adjacent a rear end of said nozzle base;

an upright housing pivotally mounted on said nozzle base;

a suction source mounted to one of said nozzle base and said upright housing;

a filter chamber located in one of said nozzle base and said upright housing;

a drive motor mounted to one of said nozzle base and said upright housing, said drive motor having an output shaft;

a geared transmission coupled to said output shaft of said motor, said transmission comprising a transmission housing for supporting said drive motor, positioned within one of said upright housing and said nozzle base;

and a driven wheel coupled to said transmission, wherein said driven wheel is mounted to said nozzle base at a location forward of said at least one support wheel.

2. The vacuum cleaner of claim 1 further comprising a pinion gear mounted on said output shaft of said motor, said pinion gear engaging said geared transmission.

3. The vacuum cleaner of claim 2 further comprising a sprocket engaging said geared transmission.

4. The vacuum cleaner of claim 1 wherein said transmission housing includes a portion for accommodating an axle of said driven wheel.

5. The vacuum cleaner of claim 1 further comprising a roller mounted to said nozzle base, said roller being located forwardly of said at least one support wheel.

6. A direct drive self propelled vacuum cleaner comprising:

a nozzle base having a suction inlet and a pair of support wheels located adjacent a rear end of said nozzle base;

a housing pivotally mounted on said nozzle base;

a handle mounted to said housing;

a suction source mounted to one of said nozzle base and said housing;

a filter chamber located in one of said nozzle base and said housing;

a drive motor mounted to one of said nozzle base and said housing, said drive motor having an output shaft;

a control located on one of said housing and said nozzle base for directing a rotational direction and a speed of said drive motor, said control comprising:

a sleeve mounted for reciprocation on said handle, and a Hall effect sensor for detecting a pulling force and a pushing force on said sleeve;

a transmission directly coupled to said output shaft of said drive motor; and a transmission housing for accommodating said transmission, said transmission housing comprising a support located within said nozzle base for mounting said motor, wherein said transmission housing is mounted to one of said nozzle base and said upright housing; and, a driven wheel directly coupled to said transmission said driven wheel being mounted to said nozzle base and being located forwardly of said pair of support wheels.

7. The vacuum cleaner of claim 6 wherein said control comprises a trigger mounted on said handle extending from said housing.

8. The vacuum cleaner of claim 7 wherein said control further comprises a neutral return spring for biasing said sleeve to a neutral position.

9. The vacuum cleaner of claim 8 wherein said control further comprises:

a circuit in communication with said sensor and said motor for directing said motor to rotate in a first direction and in a second direction and to cease rotation.

10. The vacuum cleaner of claim 9 wherein said sensor detects an amount of movement of said sleeve in relation to said handle and said circuit directs said motor to rotate at a speed of rotation commensurate with a degree of movement of said sleeve in relation to said handle.

11. The vacuum cleaner of claim 9 wherein said control further comprises a first magnet spaced from said Hall effect sensor.

12. The vacuum cleaner of claim 11 wherein said sensor further comprises a second magnet spaced from said Hall effect sensor and said first magnet.

13. The vacuum cleaner of claim 9 further comprising a roller mounted to said nozzle base, said roller being located forwardly of both said pair of support wheels and said driven wheel.

* * * * *